US006571801B1

(12) United States Patent
Wuolukka et al.

(10) Patent No.: US 6,571,801 B1
(45) Date of Patent: Jun. 3, 2003

(54) TOBACCO TREATMENT PROCESS

(75) Inventors: Michael A. Wuolukka, Lizella, GA (US); Loney DeLeon Reed, Wilson, NC (US)

(73) Assignee: Brown & Williamson Tobacco Corporation, Louisville, KY (US)

( * ) Notice: Subject to any disclaimer, the term of this patent is extended or adjusted under 35 U.S.C. 154(b) by 7 days.

(21) Appl. No.: 09/705,537

(22) Filed: Nov. 3, 2000

(51) Int. Cl.[7] ..... A24B 5/06; A24B 5/00

(52) U.S. Cl. ..... 131/319; 131/313; 131/300; 131/309; 131/310

(58) Field of Search ..... 131/313, 319, 131/290, 300, 309, 310

(56) References Cited

U.S. PATENT DOCUMENTS 3,970,091 A 7/1976 Banks et al.
4,386,617 A 6/1983 Brackmann et al.
4,438,775 A * 3/1984 Mays et al. ..... 131/300
4,449,541 A 5/1984 Mays et al.
4,452,257 A 6/1984 Cartwright et al.
4,640,299 A * 2/1987 Ono et al. ..... 131/303
4,696,312 A * 9/1987 Turano et al. ..... 131/109.1
4,765,349 A 8/1988 Kagawa
4,917,161 A * 4/1990 Townend ..... 131/352
5,249,588 A 10/1993 Brown et al.
5,327,917 A * 7/1994 Lekwauwa et al. ..... 131/310
6,030,462 A * 2/2000 Shu et al. ..... 131/274

* cited by examiner

*Primary Examiner*—Steven P. Griffin
*Assistant Examiner*—Dionne A. Walls
(74) *Attorney, Agent, or Firm*—John F. Salazar; Middleton Reutlinger

(57) ABSTRACT

In a process to reduce fines and objectionable stem from tobacco in a smoking article, a humectant, particularly glycerin, is added to whole leaf tobacco prior de-stemming. After de-stemming, stems are separated from lamina and the stems and lamina are further processed for use in smoking articles, particularly cigarettes.

15 Claims, 1 Drawing Sheet

TOBACCO TREATMENT PROCESS

BACKGROUND OF THE INVENTION

This invention relates to a process for removing tobacco stems from tobacco leaves. More specifically, the present invention pertains to a process which reduces the percentages of fines in the separating of stems and lamina of tobacco leaves.

In the processing of tobacco it is necessary to remove the stems and veins from the lamina portion of the leaves in the manufacturing of smoking tobacco products. The stems and veins have undesirable burning qualities, particularly in the harshness of taste and therefore whole tobacco leaf is processed to separate the stems and veins from the lamina in order to remove their undesirable properties if they are to be used in tobacco products. Therefore, in the preparation of tobacco leaf material for use in smoking articles, it is customary to subject these tobacco leaves to a threshing operation to separate the stems and veins from the remaining portions of the leaf early in the tobacco processing for use in smoking articles. Since the remaining portion of the leaf, the lamina, is the portion of the tobacco leaf that is most desirable in the making of smoking products, in the separation of the lamina from the stems it is desirable to keep the lamina in relatively large pieces as the large pieces may be handled and shredded more easily during processing into tobacco filler for smoking articles. Moreover, in the de-stemming processing, it is important to keep the production of fines, the dust-like particles of lamina, to a minimum as the fines, unless processed further into reconstituted tobacco sheets, are not suitable for use in tobacco products. Thus, production of large amounts of fines represents a significant loss of tobacco lamina.

The stems, after separation, are further processed to remove the undesirable properties of the stems and the processed stem is then used in other smoking products. For example, these stems may be ground and used in a reconstituted tobacco product which makes for a synthetic leaf that may then be blended back in with other processed leaf portions and used in a tobacco blend for a smoking article.

In known tobacco leaf de-stemming processes, the leaf stems are separated from the leaf lamina by first subjecting the leaves to a mechanical threshing action of sufficient duration and intensity to completely detach the lamina from the stems. The resulting stem-lamina mixture is then subjected to a classification step. In typical threshers, lamina is separated from stems or veins by the action of one or more toothed rotors beating against stationary teeth, or by the action of counter-rotating toothed rotors, or by the action of a toothed rotor beating against a perforated cage or basket or by the action of a toothed rotor beating first against stationary teeth and then against a perforated cage or basket. Because of the relatively ductile nature of the tobacco lamina, it will not easily break away from the stems. Therefore, multiple impacts by the rotors are required to tear and rip the lamina from the stem.

The threshing processes currently in use, even when carefully controlled, result in a production of a preponderance of small pieces of lamina. Moreover, an unacceptable amount of tobacco fines is produced because of the pulverizing action of the toothed rotors and the multiple impacts required to completely detach all of the lamina.

SUMMARY OF THE INVENTION

It is an object of the present invention to provide a process to increase separation of stem and lamina and for reducing the amount of fines from the de-stemming of a tobacco leaf.

It is a further object of the present invention to provide a process for treating tobacco leaves, prior to de-stemming, with a humectant.

It has been found that with the addition of a humectant to whole tobacco leaf prior to the de-stemming operation, the amount of lamina fines produced in the de-stemming operation is sufficiently improved over present commercially acceptable processes for de-stemming.

Particularly, the present invention provides a process for treating and processing whole leaf tobacco comprising the steps of adding a humectant to whole tobacco leaf; separating stems from lamina of the tobacco containing the humectant; and, transferring the treated lamina to storage.

It has been found that by applying humectant(s), particularly glycerin in a concentration of from 0.5% by weight to 1.5% by weight of the whole leaf tobacco prior to the first de-stemming or threshing stage significantly reduces both total and objectionable stem content of the lamina in present commercially available equipment under existing operating conditions with no increase in tobacco degradation.

BRIEF DESCRIPTION OF THE DRAWING

The FIGURE is a schematic illustration of one preferred embodiment of the present invention.

BRIEF DESCRIPTION OF THE PREFERRED EMBODIMENTS

Figure 1:
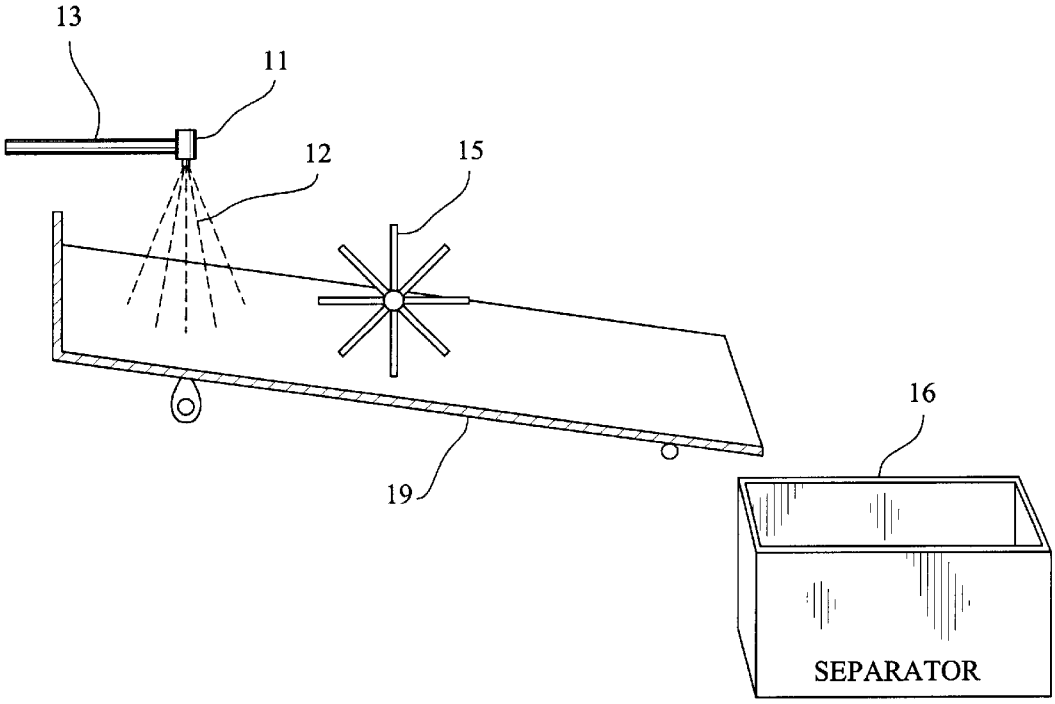

In the process of the present invention, and particularly as shown schematically in the FIGURE, whole tobacco leaves are fed onto a vibrating conveyor 19. The leaves pass under a spray of humectant 12, usually glycerin, issuing from a spray head 11 which is supplied humectant by a distribution conduit 13. The sprayed leaves are then carried under a mechanical threshing machine, such as a rotating doffer 15, where the lamina is detached from the stems. The inner-mingling of stem and pieces of lamina are subsequently carried into a commercially available separator means 16, such as a counter flow separator or a vertical lift separating conveyor. Doffer 15 may be replaced with other threshing means, such as a wire reinforced rubber piping contact with a vibrating conveyor of multiple doffers. Multiple doffers rotating at different speeds may also be employed.

In the preferred embodiments of the present invention, the liquid humectant spray rate and batch spray time are selected to produce a uniform distribution of the humectant in the leaf. Moreover, the humectant may be mixed with water thereby reducing the viscosity of the humectant in the spraying solution so that the humectant is more easily applied to the leaves. Generally the humectant is added to a water solution at from about 0.5 to 1.5% by weight of the tobacco at from about 10 to 50 centipoise at a typical processing temperature of about 75° F. In the case of glycerin, generally the glycerin makes up 70% by weight of the spraying solution with water being the remaining 30%.

For a better understanding of the present invention, the following is examples illustrate the effect of selected humectants on whole leaf tobacco prior to threshing.

EXAMPLE I

Burley tobacco was split into two segments, one segment (Control) was untreated and the other segment (Test) was treated with 0.9% glycerin by weight of the tobacco, the glycerin being applied in a glycerin/water solution containing 70% by weight of glycerin at 75° F. The glycerin solution was applied to whole leaf tobacco prior to threshing. The threshed tobacco was then passed through a separator wherein the stems were separated from the lamina. At the separator, analytical determinations were made of the separated tobacco to determine the amount of leaf greater than one-half inch (½"), the amount of fines produced from the threshing, this being that portion of lamina being less than one quarter-inch (¼"), as well as the amount of stem in the lamina (SIL) and objectionable stem (OS) in the product. (SIL is the amount of stem remaining in the lamina after leaf processing and the OBJ is the large objectionable stem remaining in the lamina after processing.) The Table below shows the results of the comparisons of these analytical measurements.

TABLE 1

| TREATMENT | PARTICLE SIZE | | | |
|---|---|---|---|---|
| DESCRIPTION | +1/2" | −1/4" | SIL | OS |
| CONTROL | 66.1% | 8.3 | 1.90% | 0.41% |
| TEST | 67.7% | 7.5% | 1.55% | 0.20% |
| DIFFERENCE | 0.02 | −0.8% | −0.35% | −0.21% |
| % CHANGE | +2 | −10% | −18 | −51% |

From the above Table 1 it is seen that glycerin significantly reduced the fines (−¼") as well as the amount of stem in the lamina and the objectionable stem. Specifically, reductions with the use of glycerin were 10% in the amount of fines and 18% in the amount of stem.

After one year aging, the glycerin content was found to be 0.6%. The control and test tobacco were cased with glycerin to normalize both to 2% glycerin to tobacco by weight. Analytical measures were made of the Control and Test when made into a cigarette product. Table 2 below shows the comparison of these results.

TABLE 2

| | PARTICLE SIZE | | | |
|---|---|---|---|---|
| TREATMENT DESCRIPTION | +9 MESH | −14 MESH | SIL | OS |
| CONTROL | 56.5% | 16.7% | 3.30% | .36% |
| TEST | 58.8% | 15.9% | 3.13% | .37% |
| DIFFERENCE | 2.3% | −0.8% | −0.17% | .01% |
| % CHANGE | 4% | −5% | −5% | 1% |

The application of glycerin to whole leaf burley tobacco resulted in improved in-cigarette particle size with no increase in stem content.

While only one example of the present invention has been described, it will be apparent to those skilled in the art that various modifications and variations could be made in the described example without departing from lo the scope and spirit of the invention.

What is claimed is:

1. A process for treating a whole leaf tobacco comprising the steps of:

spraying a humectant onto whole leaf tobacco;

threshing stems from lamina of said tobacco containing said humectant;

separating said stems from said lamina; and, transferring said lamina to storage.

2. The process of claim 1 wherein said humectant is glycerin.

3. The process of claim 1 wherein said humectant is added at from 0.5 to 1.5% by weight of the tobacco.

4. The process of claim 3 wherein said humectant is added in a water solution at from 10 to 50 centipoise.

5. A method for separating lamina from whole tobacco leaves comprising the steps of:

spraying whole tobacco leaves uniformly with a humnectant;

threshing said tobacco leaves to detach lamina from stems;

separating said lamina from said stems; and aging said lamina.

6. The method of claim 5 wherein said humectant is glycerine.

7. The method of claim 6 wherein said humectant is added at from 0.5 to 1.5% by weight of tobacco.

8. The method of claim 6 wherein said humnectant is added in a water solution having a viscosity of from 10 to 50 centipoises.

9. The method of claim 8 wherein said humectant is at a concentration of 70% by weight of said water solution.

10. The method of claim 5 wherein said threshing is accomplished by at least one rotating doffer.

11. The method of claim 10 wherein said threshing is accomplished by a plurality of rotating doffers, each of said doffers rotating at a unique speed relative to other of said rotating doffers.

12. The method of claim 5 wherein said threshing is accomplished by a wire reinforced rubber piping contact.

13. The method of claims 5 wherein said separating said lamina from said stems is accomplished by a counter flow separator.

14. The method of claim 5 wherein said separating said lamina from said stems is accomplished by a vertical lift separating conveyor.

15. A method for separating lamina from whole tobacco leaves comprising the steps of:

spraying whole tobacco leaves uniformly with glycerine, wherein said glycerine is added at from 0.5–1.5% by weight of the tobacco in a water solution having a viscosity of from 10 to 50 centipoises and wherein said glycerine is at a concentration of 70% by weight of said water solution;

threshing said tobacco leaves to detach lamina from stems;

separating said lamina from said stems; and aging said lamina for a period of time.

* * * * *